United States Patent [19]

Miller

[11] Patent Number: 4,936,573

[45] Date of Patent: Jun. 26, 1990

[54] EXERCISE MACHINE WITH HANDLE ASSEMBLIES WHICH ARE LINKED TO PIVOTING FOOT PADS

[76] Inventor: Samuel Miller, 2724 N. Garden Dr., Apt. 302, Lake Worth, Fla. 33461

[21] Appl. No.: 320,161

[22] Filed: Mar. 7, 1989

[51] Int. Cl.[5] ..... A63B 21/00

[52] U.S. Cl. ..... 272/131; 272/73

[58] Field of Search ..... 272/73, 131, 132, 72, 272/DIG. 6, 68, 96, 97, 71; 128/25 R

[56] References Cited

U.S. PATENT DOCUMENTS

| | | | |
|---|---|---|---|
| 1,905,019 | 4/1933 | Turner . | |
| 2,668,709 | 2/1954 | Boyko . | |
| 2,673,088 | 3/1954 | Wentz . | |
| 2,921,791 | 1/1960 | Berne | 272/132 |
| 3,057,201 | 10/1962 | Jaeger | 272/73 |
| 3,132,861 | 5/1964 | Horney | 272/68 |
| 3,640,525 | 2/1972 | Proctor | 272/132 |
| 3,738,649 | 6/1973 | Miller . | |
| 4,084,810 | 4/1978 | Forsman | 272/DIG. 6 |
| 4,233,844 | 11/1980 | Dreisinger et al. | 272/DIG. 6 |
| 4,249,729 | 2/1981 | Gabrielidis | 272/68 |
| 4,402,502 | 9/1983 | Peters | 272/73 |
| 4,452,448 | 6/1984 | Ausherman . | |
| 4,550,908 | 11/1985 | Dixon . | |
| 4,632,123 | 12/1986 | Govaert et al. | 272/73 |
| 4,645,200 | 2/1987 | Hix | 272/73 |
| 4,659,075 | 4/1987 | Wilkinson | 272/132 |
| 4,690,398 | 9/1987 | Smith . | |
| 4,739,984 | 4/1988 | Dranselka . | |
| 4,762,317 | 8/1988 | Camfield et al. . | |
| 4,773,399 | 9/1988 | Richardson | 272/73 |

*Primary Examiner*—Stephen R. Crow

*Attorney, Agent, or Firm*—Spencer & Frank

[57] ABSTRACT

An exercise machine for elderly or handicapped people includes left and right exercise mechanisms which are substantially identical. Each exercise mechanism includes an adjustable handle assembly which is connected to an adjustable friction mechanism. Each exercise mechanism also includes a pivotably mounted foot pad which is connected by a linkage mechanism to the respective handle assembly. During use, the person sits on a support such as a chair or bed with the exercise machine in front of him. With his feet resting on the pivotably mounting foot pads, the person pushes and pulls the handle assemblies, either alternately or in unison. This stroking motion causes the foot pads to pivot up and down, thereby stimulating the person's feet and legs by flexing the joints and stretching the muscles.

16 Claims, 5 Drawing Sheets

FIG. 5
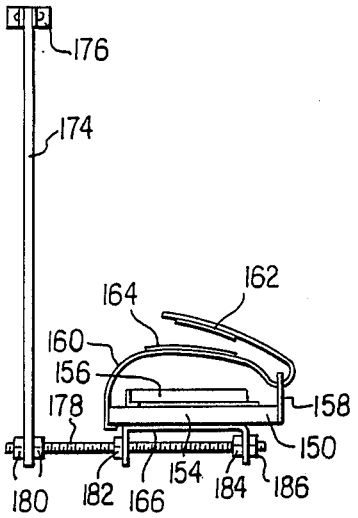
FIG. 6
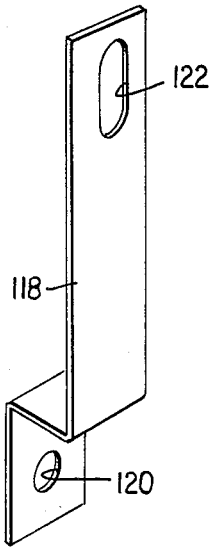
FIG. 7
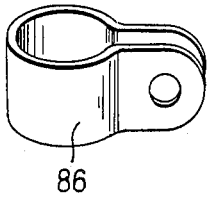
FIG. 8
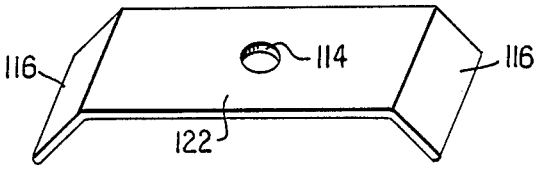
FIG. 9
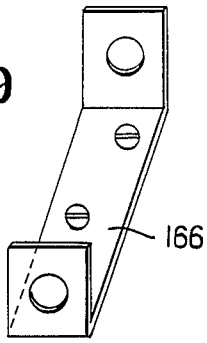
FIG. 10
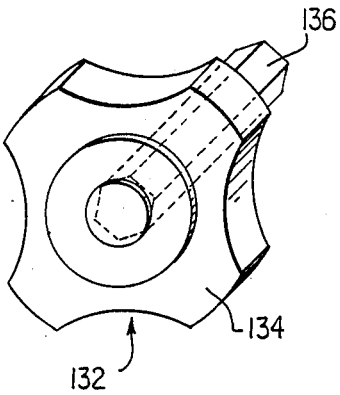
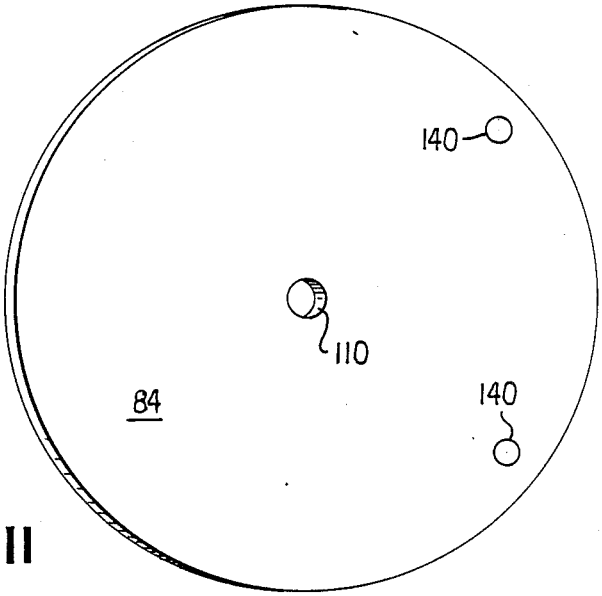
FIG. 11

EXERCISE MACHINE WITH HANDLE ASSEMBLIES WHICH ARE LINKED TO PIVOTING FOOT PADS

BACKGROUND OF THE INVENTION

The present invention is directed to an exercise machine, and more particularly to an exercise machine suitable for use by elderly or handicapped persons.

A wide variety of exercise machines are known in the prior art. In some machines weights are lifted or springs are stretched, while in other machines the exercisor works against a friction mechanism. Exercise machines are frequently targeted at one set of muscles, and if the exercisor wishes to exercise another set he must switch to another machine. Some conventional exercise machines require that the exercisor stand beside the machine, and other exercise machines require that the exercisor sit or lie on the machine or otherwise mount it. For example, a person is typically required to mount a bicycle-type exercise machine in much the same manner that he would mount a real bicycle.

The conventional exercise machines outlined above might be used by bodybuilders to increase their muscular bulk, or by athletes to increase their muscular bulk and their endurance. Conventional exercise machines are also frequently used by weight-conscious people to burn calories. Many active adults also use conventional exercise machines to improve or maintain their physical fitness.

While elderly or handicapped people frequently have little interest in increasing muscular bulk or improving athletic performance, many of them (and their physicians) appreciate the beneficial effects of physical exercise in order to maintain or increase physical fitness. Unfortunately mobility is frequently a problem with elderly or handicapped persons, making it difficult for them to travel to an exercise salon where a variety of exercise machines for exercising different sets of muscles are available. Furthermore, exercise machines which are intended for use by more hearty people may be physically too demanding for elderly or handicapped people. This is particularly true of the legs and feet. A person with impaired blood circulation in his legs or feet or who suffers from arthritis in his joints may not be able to use a bicycle-type exercise machine, for example, even though he might benefit by the stimulation which would result from the flexing of joints and the stretching of muscles in his feet and legs.

It is probably widely appreciated that conventional exercise machines may be actually dangerous to elderly or handicapped people if the machines are too physically demanding and cannot be adjusted to accommodate people having reduced strength and endurance. Even a discontinuous range of adjustments that might be suitable for a more vigorous person, who probably has the endurance to exercise effectively at an adjustment setting that may be a little more difficult than he would prefer, may be unsuitable for elderly or handicapped people. A danger that may not be widely appreciated, however, is that an elderly or handicapped person risks a fall if he is required to mount an exercise machine in order to use it. This danger is particularly acute for elderly people, who may have brittle bones and may additionally suffer from an impaired sense of balance.

Exercise machines intended for people with reduced physical abilities have not been entirely ignored in the prior art. For example, U.S. Pat. No. 4,550,908 discloses an exercise machine for impaired people such as stroke victims. In this machine an exercisor sits in a seat which forms part of the machine and straps his feet into foot support members which are connected to hydraulic cylinders. He additionally grasps two adjustable handle assemblies which are also connected to hydraulic cylinders. A network of valves connecting the hydraulic cylinders permits an exercisor to use sound limbs on one side of his body to provide stimulation for inactive limbs on the other side, for example. However, due to the presence of the hydraulic system the exercise machine of U.S. Pat. No. 4,550,908 is inherently expensive and heavy. It is also relatively large, and in view of both its size and weight the machine would be inappropriate for use in a residential setting. Furthermore, the exercisor is required to mount the machine in order to use it.

SUMMARY OF THE INVENTION

An object of the invention is to provide an exercise machine which avoids the defects discussed above.

Another object of the invention is to provide an inexpensive and portable exercise machine which permits an elderly or handicapped to exercise his upper body, particularly his arms, while stimulating his legs and feet by flexing the joints and stretching the muscles. A related object is to also permit an elderly or handicapped person to have the option of actively exercising his lower body while using the machine if he so desires.

A further object of the invention is to provide an exercise machine which an elderly or handicapped person need not mount in order to use. Instead, he can sit on a support which is not a part of the exercise machine. Indeed, the exercisor may exercise while sitting in a wheelchair or, if he is bedridden, even while sitting at the edge of his bed.

Still another object of the invention is to provide a compact exercise machine having two independent but substantially identical exercise mechanisms, each including an adjustable handle assembly which is connected to an adjustable friction mechanism and which is coupled via a linkage mechanism to a pivotably mounted foot pad. Each friction mechanism provides resistance both when the associated handle assembly is pushed and when it is pulled. With separate exercise mechanisms, the person has the option of either stroking the handle assemblies in unison, as in a rowing machine, or in an alternating manner, as in a skiing machine. These different modes of operation permit the person to selectively exercise some sets of muscles more vigorously than others. Moreover, the person can switch from one mode to the other if he finds himself becoming bored. Either mode of operation permits an elderly or handicapped person to actively exercise his arms and the rest of his upper body while passively stimulating or actively exercising his lower body, so that the expense of different machines for use with the upper body and the lower body is unnecessary.

As will become apparent in the ensuing detailed description, these and other objects of the invention can be attained by providing a portable chassis which is movable with respect to a support on which a person sits, an elongated handle assembly which is graspable by the person adjacent its top end, means adjacent the bottom end of the handle assembly for pivotably connecting the handle assembly to the chassis to permit the person to stroke the handle assembly back and forth, a pivotably mounted foot pad to support one of the person's feet, and means for mechanically linking the handle assembly to the foot pad so that the person's foot is caused to rock when the person strokes the handle assembly, this means being connected to the handle assembly between the top and bottom ends of the handle assembly.

In accordance with another aspect of the invention, an exercise machine for use by a seated person includes a chassis, left and right friction mechanisms which are mounted on the chassis and which are independently adjustable, left and right handle assemblies which are connected respectively to the left and right friction mechanisms, each handle assembly having a manually graspable portion which the person can stroke back and forth independently of the other handle assembly, pivotably mounted left and right foot pads to support the person's feet, and means for rocking the left foot pad in unison with the back and forth strokes of the left handle assembly and for rocking the right foot pad in unison with the back and forth strokes of the right handle assembly.

BRIEF DESCRIPTION OF THE DRAWINGS

FIG. 5 is an end view of the left foot pad and linkage mechanism;

FIG. 6 is a perspective view of an anchor member which keeps the resistance adjustment knob from creeping during use of the exercise machine;

FIG. 7 is a perspective view of a pipe clamp which is employed with the handle assemblies.

FIG. 8 is a perspective view of a spring member which participates in the resistance setting;

FIG. 9 is a perspective view of one of a pair of brackets which is used with each foot pad;

FIG. 10 is a perspective view of a resistance adjustment knob; and

FIG. 11 is perspective view of a disk which is employed in an adjustable friction mechanism.

DESCRIPTION OF THE PREFERRED EMBODIMENT

Figure 1:
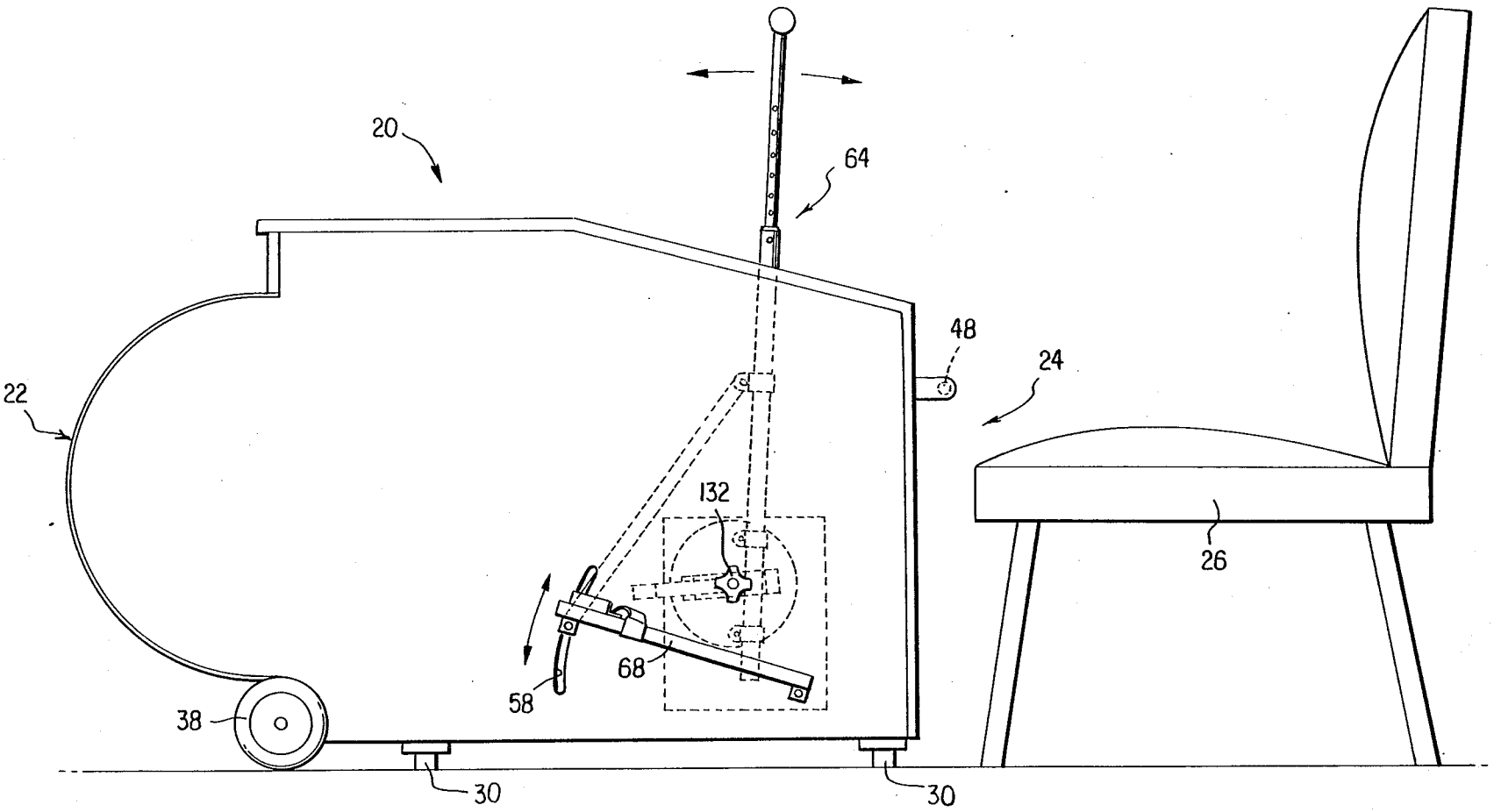
FIG. 1 is a left side view of an exercise machine in accordance with the present invention positioned before a support for a person, and illustrates the movement of the handle mechanisms in unison.

FIG. 1 illustrates a left side view of an exercise machine 20 in accordance with the present invention. Exercise machine 20 has a back end 22 and a front end 24 which, when exercise machine 20 is in use, is positioned adjacent a support 26 on which the person who is exercising (hereafter occasionally deemed the "exercisor") with the aid of machine 20 sits.

Figure 2:
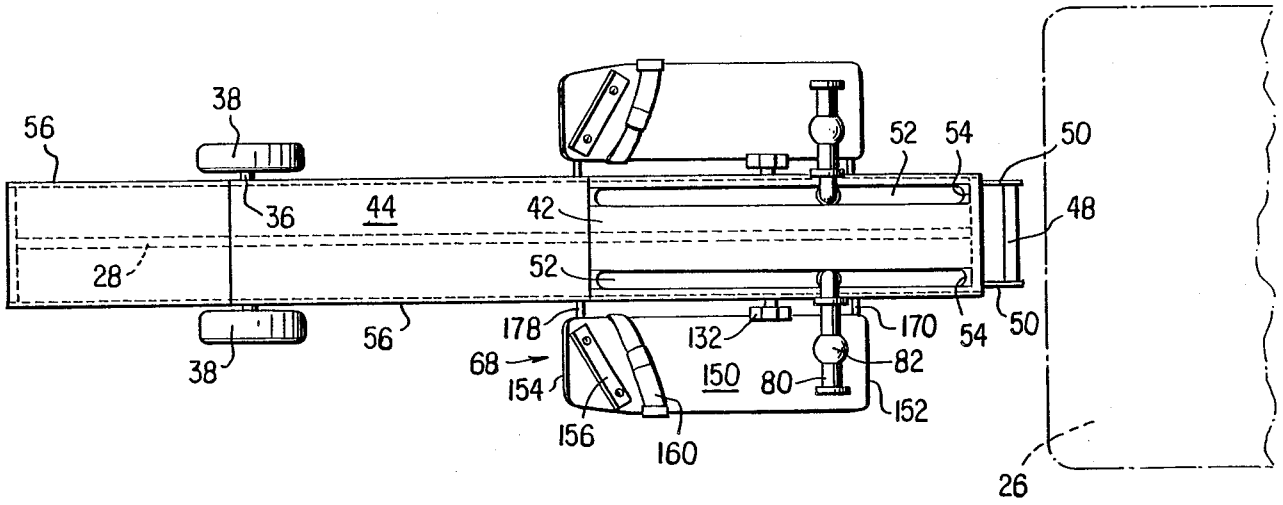
FIG. 2 is a top plan view of the exercise machine with the handle assemblies positioned as shown in FIG. 1.
Figure 3:
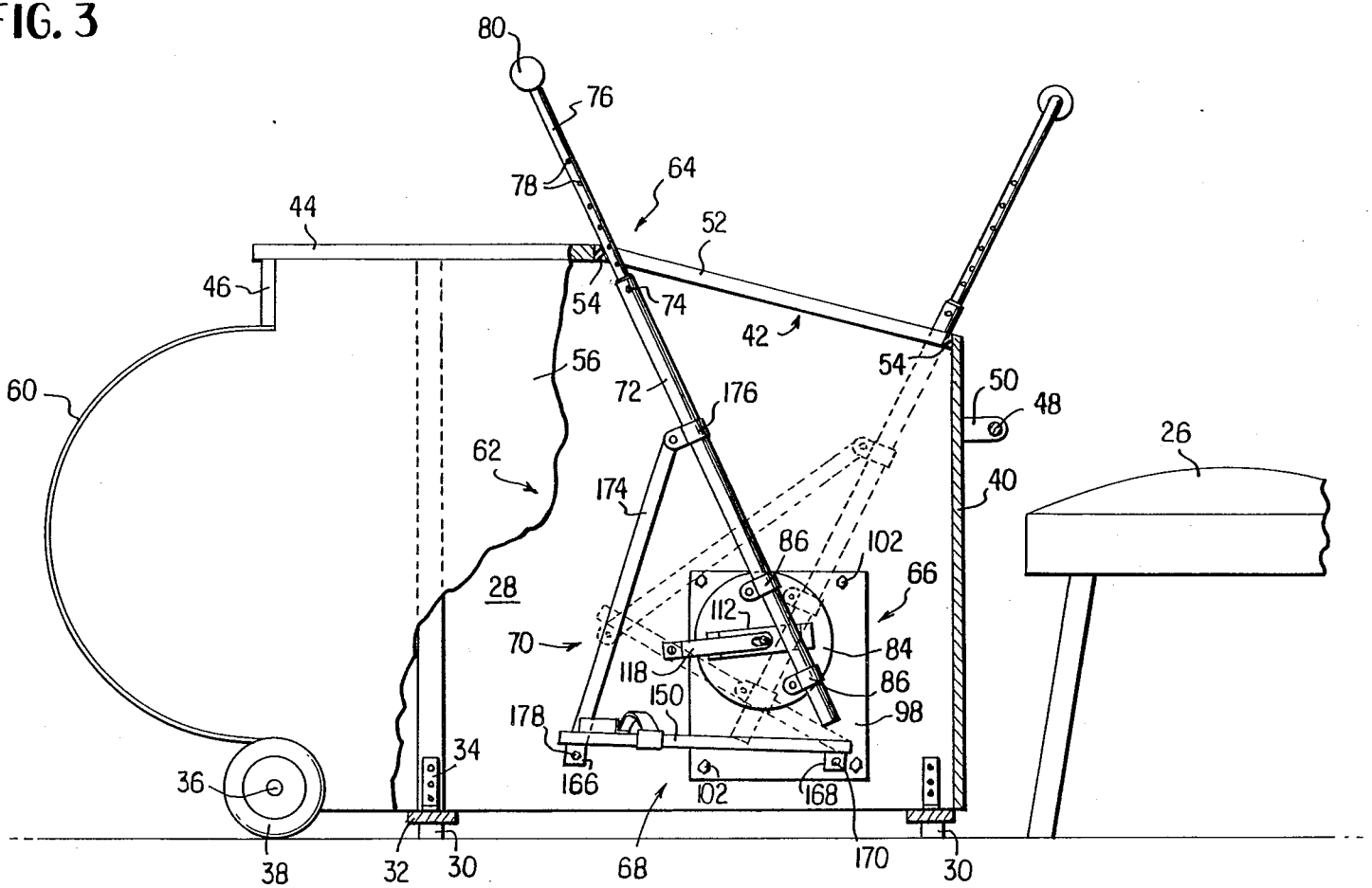
FIG. 3 is a left side view of the exercise machine with a portion of its cover panel broken away, and shows the handle mechanisms spaced apart from one another as they would be during the alternating mode of operation.

Referring next to FIG. 1-3 together, exercise machine 20 has a chassis or framework which includes a central panel 28, which may be made of plywood. Foot members 30 are connected to strips 32 which are in turn connected at right angles to panel 28 by brackets 34 or the like, thereby supporting panel 28 in a vertical position as shown. Furthermore, an axle 36 is connected perpendicular to panel 28 and rotatably supports wheels 38. The chassis of exercise machine 20 further includes a front panel 40, a sloping top panel 42, a horizontal top panel 44, and a short back panel 46, all of which are attached to panel 28. A lift handle 48 is connected to front panel 40 by brackets 50. As is best shown in FIG. 2, sloping top panel 42 has two slots 52, one on either side of central panel 28. Resilient bumper members 54 are attached to top panel 42 at either end of both of the slots 52.

Cover panels 56 are affixed to the chassis on both the left and right sides of machine 20. Each cover panel 56 has an arcuate slot 58 (see FIG. 1). The housing of exercise machine 20 is completed by a back cover 60, which may be curved as illustrated for aesthetic purposes.

Exercise machine 20 includes two independent exercise mechanisms, one for the left side of the exercisor and one for the right side. Since the exercise mechanisms are substantially identical, only the left exercise mechanisms 62 will be described in detail.

Referring to FIG. 3, left exercise mechanism 62 includes an adjustable handle assembly 64 which is connected to an adjustable friction mechanism 66 mounted on the left side of central panel 28. Mechanism 62 also includes a pivotably mounted foot pad 68, and a linkage mechanism 70 between foot pad 68 and handle assembly 64. These features will be described in detail in the following paragraphs.

Adjustable handle assembly 64 will now be described, with principal reference to FIGS. 2 and 3. Assembly 64 includes a lower pipe 72 having a bore 74 near the upper end thereof. Assembly 64 also includes an upper pipe 76 which fits telescopically into lower pipe 72. Upper pipe 76 has a series of bores 78. It will be apparent that bore 74 is exposed when handle assembly 64 is positioned toward front panel 40, thereby permitting the height of assembly 68 to be adjusted by aligning an appropriate bore 78 with bore 74 and inserting a securing means (such as a screw held by a bolt, not illustrated) through the aligned bores. The upper portion of pipe 76 is bent outward, and a foam grip member 80 is inserted over it. Grip member 80 has a central ball portion 82 which is relatively resilient.

As will be discussed, friction mechanism 66 includes an outer face plate such as disk 84, and handle assembly 64 is connected to friction mechanism 66 via pipe clamps 86 which are secured to disk 84.

Figure 4:
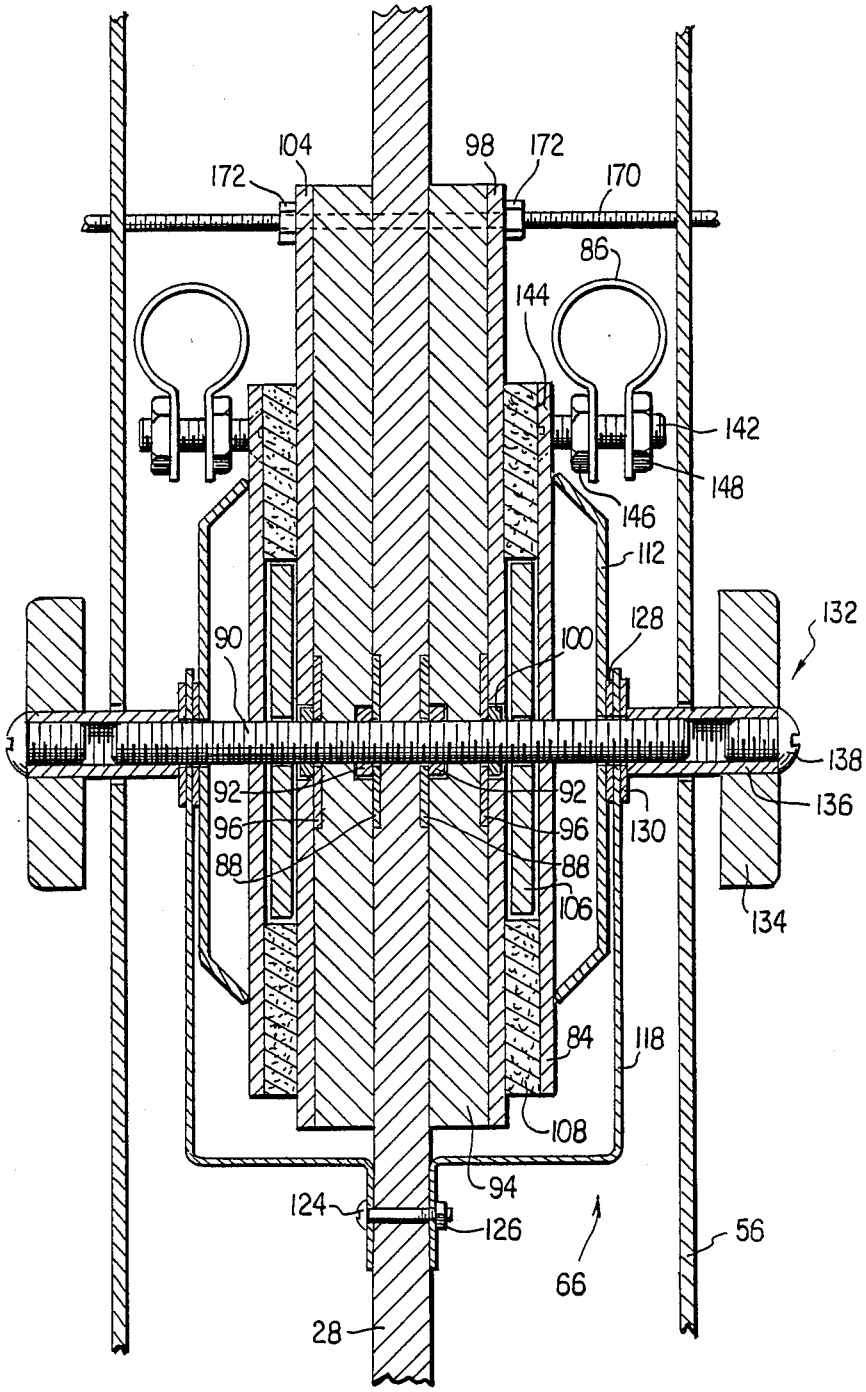
FIG. 4 is a sectional view through the left and right adjustable friction mechanisms of the exercise machines.

Turning next to FIG. 4, the adjustable friction mechanism 66 will now be described. A bore extends through central panel 28 and a recess is provided around the bore to accommodate washers 88. A threaded shaft 90 is inserted through the bore and through washers 88, and is secured by nuts 92 and nuts 100. One side of spacer panel 94 has a recess to receive nut 92, and the other side has a recess to accommodate washer 96. An inner metal face plate 98 has an opening to accommodate nut 100, which is screwed onto shaft 90. Although not shown in FIG. 4, fasteners 102 (see FIG. 3) extend through face plate 98 and through face plate 104 on the other side.

Next comes a washer 106, which fits inside a circular opening in friction ring 108. The purpose of washer 106 is to keep friction ring 108 centered about shaft 90. Outer disk 84 has a central opening 110 (see FIG. 11) through which shaft 90 extends. Spring member 112

(also see FIG. 8) has an opening 114 for passage of shaft 90 and legs 116 which are directed toward disk 84.

FIG. 6 illustrates an angle member 118 having an opening 120 near one end and an opening 122 near the other. As is shown in FIG. 4, member 118 is attached to panel 28 by a bolt 124 which extends through opening 120 and by a nut 126. Shaft 90 extends through opening 122, which is elongated (see FIG. 6) in order to facilitate fabrication of friction mechanism 66 by keeping the placement of screw 124 from being critical. A washer 128 is positioned between spring member 112 and angle member 118 and a washer 130 is disposed on the other side of member !18.

Referring next to FIGS. 4 and 10 together, adjustment knob 132 includes a handle portion 134 with a central opening. A hollow shaft 136 is mechanically attached to handle portion 134 at its front opening. The interior of shaft 136 is threaded, and a bolt 138 is screwed into the outer end of shaft 136 to hold the knob assembly together. The other end of shaft 136 is screwed onto shaft 90 and presses against washer 130. It will be apparent that adjustment knob 132 permits manual adjustment of the tension of spring member 112, and thus permits one to control how tightly friction ring 108 is sandwiched between face plate 98 and disk 84. It will also be apparent that friction mechanism 66 is adjustable independently from the friction mechanism on the other side of panel 28.

The attachment of handle assembly 64 (see FIG. 3) to friction mechanism 66 will now be described in more detail. As is shown in FIG. 11, disk 84 is provided with two peripheral holes 140. Holes 140 are conically enlarged on the side of disk 84 which is not shown in FIG. 11. In FIG. 4, screw 142 has a conical head 144 which fits into the conical enlargement of one of the openings 140, thereby affixing the screw 142 to the disk 84. Pipe clamp 86 (also see FIG. 7) is then mounted on screw 142 between nuts 146 and 148. The other pipe clamp 86 (see FIG. 3) is attached to disk 84 in the same way. After pipe 72 is inserted through pipe clamps 86, the nuts 148 are tightened to securely attach the adjustable handle assembly 64 to the adjustable friction mechanism 66. It should be noted that, in order to facilitate the foregoing description, FIG. 4 illustrates the adjustable friction mechanisms before this attachment, and with disk 84 rotated from the position shown in FIG. 3 to permit the attachment of pipe clamp 86 to disk 84 to be clearly shown along with the remainder of the structure illustrated in FIG. 4.

The pivotably mounted foot pad 68 for the left side of exercise mechanism 62 will now be described. In FIG. 2, cushioned foot rest 150 has a heel end 152 and a toe end 154. A toe support 156 is affixed to the upper side of foot rest 150 adjacent toe end 154. Toe support 156 rises above the rest of the surface of foot rest 150, as is shown in FIG. 5, and is mounted at an angled position as shown in FIG. 2. The angled position is selected to generally follow the "knuckles" of the toes on the exercisor's foot.

In FIG. 5, a bracket 158 is attached to one side of foot rest 150. At the other side, one end of a strap 160 is attached to foot rest 150. Strap 160 loops through a opening (not illustrated) in bracket 158. Near the free end of strap 160 is affixed one component 162 of a "hook and loop" fastener. The other component 164 of the fastener is attached to strap 160. Hook and loop fasteners are commercially available under the trademark "VELCRO," for example.

Turning next to FIG. 3, a bracket 166 is attached to the underside of foot rest 150 adjacent its toe end. Bracket 166 is illustrated in FIG. 9, and it will be noted that it has an ear portion at either end, and an opening in each ear portion. A bracket 168 is attached to the underside of foot rest 150 adjacent the heel end. Bracket 168 has the same configuration as bracket 166.

Returning to FIG. 4, a threaded shaft 170 extends through aligned bores (not illustrated) in face plates 98 and 104 and the panels sandwiched there between. Shaft 170 is secured by nuts 172, and extends through an opening (not illustrated) in cover panel 56. As is shown in FIG. 3, shaft 170 extends through the openings in bracket 168, so that the heel end of foot pad 68 is pivotably mounted on shaft 170. Although not shown in FIG. 3 due to the reduced size of the drawing, nuts are screwed onto shaft 170 to hold bracket 168 in place.

The linkage mechanism 70 connecting foot pad 68 to handle assembly 64 will now be described with reference to FIGS. 1, 3, and 5. As is shown in these Figures, the upper end of a connecting bar 174 is pivotably attached to pipe 72 via a pipe clamp 176. At its lower end, bar 174 has an opening (not illustrated) through which threaded shaft 178 extends. Shaft 178 is attached to bar 174 by lock nuts 180. Shaft 178 extends through arcuate slot 58 (see FIG. 1) in cover panel 56 and through the openings in bracket 166 attached at the toe end of foot rest 150. During assembly of exercise machine 20, lock nut 182 is first screwed onto shaft 178 to establish the inward position of the toe end of foot pad 68, and shaft 178 is then inserted through the opening in the inner ear of bracket 166. A lock nut 184 is then screwed well onto shaft 178. After this, foot pad 150 is moved inward until the inner ear of bracket 166 contacts nut 182, whereupon nut 184 is screwed outward until it contacts the other ear of bracket 166. A lock nut 186 is then screwed onto shaft 178 until it rests lightly against bracket 166. Lock nuts (i.e., 180, 182, 184, and 186) are employed because they remain tight despite the normal motion of shaft 178. Although not shown, washers are preferably used between bracket 166 and nuts 184 and 186. It is noted that bracket 168 at the heel end of foot rest 150 is preferably connected to shaft 170 in a manner similar to that discussed above.

Now that exercise machine 20 has been described structurally, its operation will also be discussed.

The benefits of exercise machine 20 are particularly significant if the exercisor is an elderly or handicapped person. With reference to FIGS. 1–3, the exercisor sits on support 26 and places his feet on the foot pads 68. If desired his feet may be tethered using straps 160. If necessary the height of the handle assemblies 64 is adjusted as previously described and the desired tension on each side is set using the adjustment knobs 132 (such adjustments are, of course, unnecessary if the same exercisor uses machine 20 repeatedly after it has been suitably adjusted for him). The exercisor then grasps the foam grip members 80 and strokes, either in unison (as in FIGS. 1 and 2) or alternately (as in FIG. 3). Frictional resistance is encountered both during the pushes and the pulls. During this stroking activity, linkage mechanisms 70 cause foot pads 68 to rock up and down. The rocking movement stimulates the exercisor's lower extremities from the hips on down, as will be discussed in more detail below. Angle member 118 (see FIG. 4) keeps the resistance set by adjustment knobs 132 constant despite the stroking motion.

One of the advantageous features of exercise machine 20 is that the exercisor may sit on the support 26 instead of having to mount the exercise machine itself, as in some conventional exercise machines. Elderly or handicapped exercisors may have difficulty mounting an exercise machine and, indeed, may injure themselves by falling while attempting to do so. Support 26 is illustrated as a conventional chair, preferably cushioned, but may be a wheelchair instead. For bedridden exercisors, support 26 may be the side of the bed. Since exercise machine 20 is quiet in operation (particularly since the thumps which might otherwise occur at the end of the strokes are absorbed by bumper members 54), it is suitable for use by bedridden patients in an institution such as a hospital, nursing home, or other facility.

When lift handle 48 is raised, wheels 38 permit machine 20 to be easily rolled to the location of support 26. The rolling stops when foot members 30 are lowered to the floor. If the machine 20 is initially positioned before the exercisor by an attendant, it is a simple matter for the exercisor to then adjust the spacing between machine 20 and support 26 to his satisfaction by raising handle 48 and pushing or pulling machine 20 slightly. Since exercise machine 20 is relatively light and compact, it can easily be rolled away for storage between uses.

If the exercisor elects to stroke the handle assemblies 64 in unison (as in FIGS. 1 and 2) he will experience a back-and-forth rocking movement throughout his entire upper body, from the neck to the hips. This rocking movement may benefit many lower back problems, as well as increasing the exercisor's overall aerobic capacity in general. Of course, the exercisor's arms, wrist, and hands are also exercised. The exercisor may also elect to stroke the handle assembly 64 in an alternating manner, as in FIG. 3. In this alternating mode of operation, the exercisor pushes the left handle assembly 64 while pulling the right handle assembly 64, and then reverses. This produces a gentle twisting of the upper body and furthermore reduces the strain on the abdominal and lower back muscles, in comparison with the unison mode of operation. Perhaps the greatest advantage of having both the unison and alternating modes available, however, is that the exercisor can shift from one mode to the other in order to reduce the tedium during an exercise session. During either mode, the exercisor may squeeze the ball portions 82 of the foam grip members 80 in order to exercise arthritic fingers and thumbs.

The work performed by the exercisor on machine 20 is conveyed via the handle assemblies 64. That is to say, the exercisor does not actively pump the foot pads 68 in the manner of a bicycle-type exercise machine. Instead, some of the work conveyed by handle assemblies 64 is transferred by linkage mechanism 70 to the foot pads 68 in order to stimulate the exercisor's lower body by stretching muscles and bending joints in his feet and legs. This is an important factor since many elderly or handicapped people have impaired circulation in the lower extremities and would not be able to exercise on a bicycle-type machine, but would nevertheless benefit by the stimulation provided by machine 20. The exercisor's toes are stimulated by being gently pushed up and down as the handle assemblies 64 are stroked. The pivoting movement of the foot pads 68 also flexes the exercisor's ankles and, to a lesser degree, his knees and hips. Assuming that the exercisor's feet are strapped in, there is a tendency for his heels to rise slightly from the foot pad 68 as they move toward their upper positions. If he desires and has the physical capacity, the exercisor may lock his ankles to augment this effect. Furthermore, he may elect to exercise his toes in a positive manner by actively straining and raising the toe end of his foot against the descending straps 160 on each push stroke of grip members 80, which causes foot pad 68 to descend.

If he elects, the exercisor might decide not to tether his feet to foot pads 68 using straps 160. Instead, he may move his feet forward until his heels rest against toe supports 156. Such a position produces a relative increase in the stimulation to some joints and muscles in the lower extremities while reducing the relative stimulation to others.

It will be apparent that the exercisor need not use both sides of exercise machine 20 simultaneously. For example, he might elect to use the left handle assembly 64 and left foot pad 68 while the right side of his body rests.

It will be understood that the above description of the present invention is susceptible to various modifications, changes, and adaptations, and the same are intended to be comprehended within the meaning and range of equivalents of the appended claims.

What I claim is:

1. An exercise machine for use by a person seated on a stationary support, comprising:

a portable chassis which is movable to the support;

an elongated handle assembly having a top end and a bottom end, the handle assembly being graspable by the person adjacent the top end thereof;

first means, adjacent the bottom end of the handle assembly, for pivotably connecting the handle assembly to the chassis to permit the person to stroke the handle assembly back and forth;

a horizontal first shaft affixed to the chassis;

a foot pad to support a foot of the person, the foot pad having a heel end and a toe end, the foot pad being mounted on the first shaft adjacent the heel end of the foot pad and being pivotably about the first shaft; and second means, connected to the handle assembly between the top and bottom ends thereof, for mechanically linking the handle assembly to the foot pad so that the person's foot is caused to rock when the person strokes the handle assembly, the second means including a second horizontal shaft connected to the foot pad adjacent the toe end thereof, and means for connecting the second shaft to the handle assembly.

2. The exercise machine of claim 1, wherein the first means comprises a friction assembly which provides resistance to the back and forth strokes of the handle assembly.

3. An exercise machine for use by a person seated on a stationary support, comprising:

a portable chassis which is movable to the support;

an elongated handle assembly having a top end and a bottom end, the handle assembly being graspable by the person adjacent the top end thereof;

first means, adjacent the bottom end of the handle assembly, for pivotably connecting the handle assembly to the chassis to permit the person to stroke the handle assembly back and forth, the first means including a friction assembly which provides resistance to the back and forth strokes of the handle assembly;

a pivotably mounted foot pad to support a foot of the person; and second means, connected to the handle assembly between the top and bottom ends thereof, for mechanically linking the handle assembly to the foot pad so that the person's foot is caused to rock when the person strokes the handle assembly, wherein the friction assembly includes an inner face plate, a threaded shaft extending from the inner face plate, an outer face plate having an opening through which the shaft extends, the handle assembly being connected to the outer face plate, a friction ring disposed between the inner and outer face plates, and means for urging the outer face plate toward the inner face plate.

4. The exercise machine of claim 3, wherein the means for urging comprises a spring member, and a friction adjustment knob having a handle portion and a hollow shaft portion which is connected to the handle portion, the hollow shaft portion having a threaded interior and being screwed onto the shaft, the hollow shaft portion pressing the spring member against the outer face plate.

5. The exercise machine of claim 4, wherein the means for urging further comprises an element between the spring member and the hollow shaft portion, and means for keeping the element from rotating.

6. The exercise machine of claim 3, wherein the friction ring has an opening with an inner diameter which is substantially larger than the outer diameter of the shaft, and wherein the friction assembly further comprises a centering washer around the shaft and within the opening of the friction ring.

7. The exercise machine of claim 1, wherein the foot pad comprises a foot rest with top and bottom surfaces, a toe support which is affixed to the foot rest and which projects above the top surface thereof, and strap means attached to the foot rest adjacent the toe support for securing the persons's foot to the foot rest.

8. The exercise machine of claim 1, wherein the handle assembly comprises a pipe, and a grip member attached to the pipe, the grip member having an enlarged portion which is resilient and manually compressible.

9. The exercise machine of claim 1, wherein the handle assembly comprises a bottom pipe, a top pipe which extends telescopically into the bottom pipe, and means for adjusting the total length of the top and bottom pipes.

10. The exercise machine of claim 1, wherein the chassis comprises a framework having front and back ends, wheels connected to the framework adjacent the back end, a non-rollable foot member connected to the framework adjacent the front end to support the front end of the framework without rolling, and a lift handle connected to the framework adjacent the front.

11. The exercise machine of claim 10, wherein the framework includes a sloping top panel with a slot therein, the handle assembly extending through the slot, and bumper members connected to the top panel at the ends of the slot.

12. The exercise machine of claim 1, further comprising:

another elongated handle assembly having a top end and a bottom end, the another handle assembly being graspable by the person adjacent the top end thereof;

third means adjacent the bottom end of the another handle assembly for pivotably connecting the another handle assembly to the chassis to permit the person to stroke the another handle assembly back and forth;

another pivotably mounted foot pad to support the other foot of the person; and fourth means, connected to the another handle assembly between the top and bottom ends thereof, for mechanically linking the another handle assembly to the another foot pad so that the person's other foot is caused to rock when the person strokes the another handle assembly.

13. An exercise machine for use by a seated person, comprising:

a chassis which includes a framework having a vertically disposed panel;

left and right friction mechanisms mounted on the chassis, the left and right friction mechanisms being independently adjustable;

left and right handle assemblies which are connected respectively to the left and right friction mechanisms, each handle assembly having a manually graspable portion which the person can stroke back and forth independently of the other handle assembly;

a pivotably mounted left foot pad to support one foot of the person;

means connected to the left foot pad for rocking the left foot pad in unison with the back and forth strokes of the left handle assembly;

a pivotably mounted right foot pad to support the other foot of the person; and means connected to the right foot pad for rocking the right foot pad in unison with the back and forth strokes of the right handle assembly, wherein the left friction mechanism, left handle assembly, left foot ad, and means connected to the left foot pad are positioned on one side of the panel, wherein the right friction mechanism, right handle assembly, right foot pad, and means connected to the right foot pad are positioned on the other side of the panel, wherein the left and right friction mechanisms are mounted on the panel, and wherein the left friction assembly includes a first threaded shaft portion which is mounted on the panel, a first face plate having an opening through which the first shaft portion extends, a second face plate having an opening through which the first shaft portion extends, the left handle assembly being connected to the second face plate, a first friction ring around the first shaft portion, the first friction ring being disposed between the first and second face plates, a first spring member having an opening through which the first shaft portion extends, and first manually adjustable means screwed onto the first shaft portion for pressing the first spring member against the second face plate.

14. The exercise machine of claim 13, wherein the right friction assembly comprises a second threaded shaft portion which is mounted on the panel; a third face plate having an opening through which the second shaft portion extends; a fourth face plate having an opening through which the second shaft portion extends, the right handle assembly being connected to the fourth face plate; a second friction ring around the second shaft portion, the second friction ring being disposed between the third and fourth face plates; a second spring member having an opening through which the second shaft portion extends; and second manually adjustable means screwed onto the second shaft portion for pressing the second spring member against the fourth face plate.

15. The exercise machine of claim 14, wherein the panel has an opening, and wherein the first and second shaft portions are part of a unitary threaded shaft which extends through the opening in the panel.

16. The exercise machine of claim 13, wherein the left handle assembly comprises a bottom pipe; a top pipe which extends telescopically into the bottom pipe, the top pipe having a bent portion; means for adjusting the total length of the top and bottom pipes; and a grip member attached to the bent portion of the top pipe, the grip member having an enlarged portion which is resilient and manually compressible; and wherein the right handle assembly comprises another bottom pipe; another top pipe which extends telescopically into the another bottom pipe; the another top pipe having a bent portion; means for adjusting the total length of the another top and another bottom pipes; and another grip member attached to the bent portion of the another top pipe, the another grip member having an enlarged portion which is resilient and manually compressible.

* * * * *